US006244815B1

(12) United States Patent
Treat

(10) Patent No.: US 6,244,815 B1
(45) Date of Patent: Jun. 12, 2001

(54) HIGH EFFICIENCY TERRY TURBINE MOTOR AND VIBRATOR

(75) Inventor: Rodney D. Treat, Benton, AR (US)

(73) Assignee: Global Mfg. Inc., Little Rock, AR (US)

( * ) Notice: Subject to any disclaimer, the term of this patent is extended or adjusted under 35 U.S.C. 154(b) by 0 days.

(21) Appl. No.: 09/246,190

(22) Filed: Jan. 12, 1999

(51) Int. Cl.[7] ..... B06B 1/16; B06B 1/18; F01D 9/02

(52) U.S. Cl. ..... 415/54.1; 415/57.4; 415/202; 366/124

(58) Field of Search ..... 415/202, 203, 415/119, 90, 92, 52.1, 54.1, 57.4, 58.4; 60/39.44, 407; 366/124, 125; 74/87

(56) References Cited

U.S. PATENT DOCUMENTS

| | | | | |
|---|---|---|---|---|
| 864,294 | * | 8/1907 | Ebert | 415/57.4 |
| 1,346,221 | | 7/1920 | Liedtke . | |
| 2,073,014 | * | 3/1937 | Jennings | 415/203 |
| 2,793,009 | | 5/1957 | Peterson . | |
| 2,875,988 | | 3/1959 | Wysong . | |
| 2,960,316 | | 11/1960 | McKellar . | |
| 3,074,151 | | 1/1963 | Kroeckel . | |
| 3,304,051 | | 2/1967 | Calhoun . | |
| 3,672,639 | | 6/1972 | Wadensten . | |
| 3,870,282 | | 3/1975 | Wadensten . | |
| 3,932,057 | | 1/1976 | Wadensten . | |
| 3,938,905 | | 2/1976 | Wadensten . | |
| 3,945,757 | | 3/1976 | Cummens . | |
| 4,232,991 | | 11/1980 | Gamell . | |
| 4,604,029 | | 8/1986 | Fink . | |
| 5,271,225 | * | 12/1993 | Adamides | 415/202 |
| 5,314,305 | | 5/1994 | Fink . | |

FOREIGN PATENT DOCUMENTS

| | | | | |
|---|---|---|---|---|
| 121 | * | of 1903 | (GB) | 415/203 |
| 1359087 | * | 7/1974 | (GB) | 366/124 |

OTHER PUBLICATIONS

"A Study of High Energy Level, Low Power Output Turbines" Dept. of the Navy, Office of Naval Research, dated Apr. 9, 1958, Job. No. 7213; AMP/TD No. 1196, Contract No. NONR–2292(00) Task No. NR 094–343, pp. 1–3 and 48.

"Turbomachines (A Guide to Design, Selection & Theory)" pp. 257 & 258 (no date).

* cited by examiner

*Primary Examiner*—Christopher Verdier
(74) *Attorney, Agent, or Firm*—Stephen D. Carver

(57) ABSTRACT

A pneumatically-driven, turbine device comprises a Terry turbine rotor coaxially disposed within a rigid housing equipped with a reentry port bordering an exhaust port. The rotor comprises a plurality of radially spaced-apart air buckets. An air pathway is established between an inlet and an exhaust outlet, extending through the reentry port, the exhaust port, and portions of the rotor buckets. The reentry port comprises a narrow arc defined in the race. At least a portion of the exhaust groove borders, but is separated from, the reentry port. Entering air initially impacts a first rotor bucket disposed adjacent the reentry port. Halves of the first two buckets are disposed radially adjacent the reentry port. Opposite halves of the first and second buckets adjoin the unmachined race area spaced apart from the reentry port. Halves of the third and fourth successive buckets are also disposed radially adjacent the reentry port, but opposite halves of the third and fourth buckets are disposed over the neck to complete the air path through the exhaust groove. When used as a pneumatic vibrator, the circular turbine wheel is unbalanced and lacks an output driveshaft. When configured as a fluid motor, the device's rotor is balanced, driving an output driveshaft.

69 Claims, 11 Drawing Sheets

HIGH EFFICIENCY TERRY TURBINE MOTOR AND VIBRATOR

BACKGROUND OF THE INVENTION

I. Field of the Invention

This invention relates generally to rotary, kinetic fluid motors of the type seen generally in United States Class 415, Subclasses 90–92. More particularly, the invention relates to pneumatic, turbine vibrators of the type classified in United States Patent Class 366 (i.e., "Agitators"), Subclasses 124 and 125.

II. Description of the Prior Art

A number of rotary, kinetic motors and vibrators have evolved over the years. Broadly speaking, such devices typically comprise a rigid housing that encloses a rotary turbine wheel. The wheel may be mounted to a suitable shaft supported by bearings on opposite sides of a receptive chamber. Air inlet and exhaust ports in fluid flow communication with the chamber establish a high-pressure air pathway through the housing that activates the rotor. The wheel comprises radially formed buckets, vanes, or blade elements at its periphery that are interposed within the airflow to produce rotation. When deployed as a motor, such devices include a working shaft splined to a balanced turbine wheel that outputs useful work. Powerful pneumatic turbine vibrators result by unbalancing the turbine wheel.

It has long been recognized by those skilled in the art that turbine vibrators offer many advantages over other types of popular vibrators. For example, properly designed turbine vibrators are smaller and more compact than similarly powered mechanical units comprising unbalanced balls, weights or shafts. By avoiding the vibrating balls or weights that are used in prior designs, substantial wear can be reduced, and reliability thus increases. Pneumatic vibrators are easier to power in many industrial environments because HP air is widely available. Ball vibrators tend to be loud and inefficient. Thus a number of turbine vibrators have been proposed in the art and many designs are in widespread use. However, many prior art turbine vibrators exhibit relatively high noise levels that often exceed 100 decibels. The power of the spectral noise outputted by many older turbine vibrators is often concentrated in higher frequency regions of the audio spectrum that are particularly dangerous to human hearing. In most cases it is no longer appropriate to install old fashioned turbine vibrators because they exceed the tolerance level of 85 decibels for continuous operation established by the OSHA Act of 1970.

U.S. Pat. No. 2,793,009 discloses a pneumatic ball vibrator having a casing defining an internal, rotary chamber. The generally cubical casing includes suitable tabs for mounting the unit in a desired location. Air inlets and outlets in fluid flow with the chamber interior establish a vigorous airflow. Vibration results as the ball forcibly impacts the rigid race within the interior.

U.S. Pat. No. 3,672,639 discloses a rigid vibrator having a case that mounts a rotary cylinder and vane arrangement. Vibration is pneumatically obtained from the resultant mechanical impact of rotating sleeves. However, both this design and older ball vibrator systems are no longer favored, as substantial benefits involving noise reduction, production cost and overall efficiency result from the use of rotary turbine vibrators such as those discussed below.

Pneumatic vibrators disclosed in U.S. Pat. Nos. 1,346,221, 2,875,988 and 2,960,316 employ rotary turbine wheels confined within rigid casings. Each turbine wheel has a circular periphery comprising a plurality of radially spaced-apart "saw teeth" interposed within an air path established though the casing. In each of these turbine vibrators air escapes from the turbine wheel teeth almost immediately after rotation begins. None of these designs provides a means whereby pressurized air traveling through the apparatus is redirected downstream through adjacent vents in the turbine housing. Instead, these older designs apply working air pressure only to a limited number of teeth. Pressure is radically dissipated as these designs lack appropriate seals between the rotor teeth and adjacent casing surfaces. In the latter two designs air pressure is vented to atmosphere through passageways adjacent the turbine wheel ends. High-pressure air is not redirected to the turbine wheel periphery to extract additional work before venting.

U.S. Pat. Nos. 3,932,057, 3,939,905, and 3,870,282 relate to high speed, low noise pneumatic vibrators. Special turbine wheel teeth and vent systems are employed to minimize noise. However, these designs are not aimed at vent redirection or power gain. Other prior art designs pertinent to the instant disclosure are seen in prior U.S. Pat. Nos. 3,074,151, 3,304,051, 3,945,757, 4,232,991, and 5,314,305.

U.S. Pat. No. 4,604,029 discloses a rotary pneumatic vibrator in which the air path is modified. A special two-section rotary impeller is mounted for rotation with a cylindrical chamber, whose periphery has small, spaced-apart pockets machined into it. These pockets modify the airflow established between the chamber inlet and outlets, purportedly increasing the radially turning forces exerted on the rotor while at the same time quieting the device.

The worth of "return stages" in the periphery of turbine rotor housings has been recognized in a paper by Silvern and Balje entitled "A Study of High Energy Level, Low Output Turbines," AMF/TD No. 1196, Department of the Navy, Office of Naval Research, Contract No. NONR-2292(00) published Apr. 9, 1958. This study suggests that the efficiency of Terry turbine rotors may be increased with certain modifications to the rotor housing periphery. Reentry ports or return stages defined in the air path can increase the resultant force of the rotor, without detracting from the other known benefits that Terry wheel turbine motors can provide.

SUMMARY OF THE INVENTION

Both of my pneumatic turbine devices employ a "Terry turbine" rotor combined with enhanced reentry ports and return stages defined in the rotor housing. A rigid metallic housing, that is generally in the form of a parallelepiped, defines a cylindrical race for the rotor. The preferred rotor is mounted between conventional bearings disposed in adjoining, circular chambers. An air pathway is established by an inlet opening in fluid flow communication with an outlet opening, both of which are machined into the casing. The preferred rotor comprises a plurality of half-moon-shaped air buckets that are radially spaced apart along its entire circular periphery. The buckets are operationally disposed adjacent the inner, radial surface of the race, in which a reentry port and an elongated exhaust groove are defined.

The reentry port is in the form of a narrow arc defined in the race. Importantly a portion of the exhaust groove borders, but is separated from, the reentry port. In the best mode the exhaust groove comprises a narrow, neck portion disposed adjacent the reentry port, which is separated therefrom by a septum. Both the reentry port and the adjoining exhaust groove neck have a width approximating half the width of a rotor bucket.

When the unit is configured as a pneumatic vibrator, the circular turbine wheel is unbalanced by affixing radially spaced apart weights non-uniformly about its circumference. No output drive shaft is employed. When the unit is configured as a fluid motor, the rotor is balanced, and includes an output driveshaft secured by adequate bearings and seals. The driveshaft extends externally from the casing for connection to a desired accessory device that is to be powered by the pneumatic motor.

In either case, air entering the casing initially impacts a first rotor bucket that is momentarily disposed adjacent the reentry port. However, the reentry port is long enough to adjoin at least four consecutive buckets at any given instant. Half of the first bucket (i.e., the bucket that is momentarily closest to the air input at a given instant frozen in time) and half of the next bucket (i.e., the second bucket) are disposed radially adjacent the reentry port. Opposite halves of the first and second buckets adjoin the unmachined race area spaced apart from the reentry port. Halves of the third and fourth successive buckets are also disposed radially adjacent the reentry port. However, opposite halves of the third and fourth buckets are disposed over a portion of the exhaust groove defined in the internal radial circumference of the rotor housing.

High-pressure air is passed into the entry jet where it is accelerated to sonic or supersonic velocity. Air directed into the first bucket is turned 180 degrees and kinetic energy is extracted. The first bucket is in fluid flow communication with the reentry port, as half of the width of the first bucket overlies the reentry port. Concurrently the reentry port is in fluid flow communication with the second, third and fourth buckets that are momentarily positioned with half of their width overlying it. The opposite half of the second bucket adjoins the inner race surface at this time, so flow though the second bucket is hampered; the second bucket does not communicate with the exhaust groove so no air is passed through this bucket. But half of the width of the third and fourth buckets overlies the exhaust groove neck, so air is vented. Reduced-energy air passes by the second bucket, through the reentry port, and thence through the third and fourth buckets where more energy is extracted by turning the high velocity air 180 degrees again.

Air must pass through the third and fourth buckets to reach the exhaust groove and therefore the exhaust port. Preferably the exhaust port is machined to form a reduced width neck portion adjoining the reentry port. Since the neck is mechanically separated from the reentry port by a septum in the housing, air transfers through the adjoining rotor buckets. The nearly-spent, reduced velocity air stream now passes through the exhaust groove. Air is ported around the wheel perimeter within the exhaust port, and it is vented though an outlet to atmosphere, preferably through a muffler.

Multiple airjets and reentry sections may be positioned around the perimeter of the rotor to increase the power of the motor version. The exhaust groove extends about the casing race, substantially between the air input and output fittings, and is at all times positioned flushly adjacent the periphery of the rotor. For a major portion of its length it is substantially the same width as the rotor buckets. The latter construction dissipates air pressure and reduces noise. At the same time, any losses in pneumatic forces applied to the rotor buckets incurred as a result of the exhaust groove configuration are more than offset by the reentry port airflow discussed above.

As a result, increased power and efficiency are attainable with my rotor and casing design. At the same time, even when configured as a vibrator, the unit is relatively quiet and complete compliance with modern industrial OSHA noise standards is achieved.

Thus an object of my invention is to provide a quiet, high speed, pneumatic rotor device that is deployable either as a fluid motor or pneumatic vibrator.

Another object is to provide a relatively quiet, high-speed turbine vibrator that maximizes the power extracted from the applied air stream.

Another object is to provide a relatively quiet, high-speed turbine air motor.

It is a further object of this invention to provide an air-actuated, turbine-type vibrator in which the air inlet diameter is proportioned to the rotor bucket diameter. It is a feature of my invention that the inlet-to-rotor bucket diameter ratio is about 30 to 31 percent.

Another object is to provide a bucket design which turns the air stream more than 120 degrees.

Another object is to provide a pneumatic vibrator of the character described that continuously operates at noise levels well below the OSHA established 85 decibel limit.

A related object is to provide highly efficient, and compact turbine vibrators and fluid motors of the character described that meets the aforesaid OSHA noise requirements.

Another object is to provide a turbine rotor of the character described enabling the airflow to be turned 180 degrees within operative buckets.

A further important object is to provide a low noise, high RPM pneumatic vibrator that produces a high degree of vibration from a relatively small volume and weight of material.

Another important object is to provide a low noise, high RPM, pneumatic motor that produces useful horsepower from a relatively small volume and weight.

A basic object is to minimize noise. It is a feature of my inventions that bucket depth and bucket quantity are carefully chosen for optimum performance.

Another object is to provide a turbine design for pneumatic vibrators and motors in which the rotor buckets are in such close proximity that the floor of one bucket is also the roof of the next bucket, thereby maximizing the number of buckets in the wheel.

Another object is to prevent or minimize the leakage of air from one bucket to the next. It is a feature of this invention that the wheel rim is sized to clear the surrounding housing by less than 0.010 inches.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 13 is a view similar to FIG. 12 that additionally pictorially depicts rotor bucket positions and the resultant air path; and.

DETAILED DESCRIPTION

Figure 1:
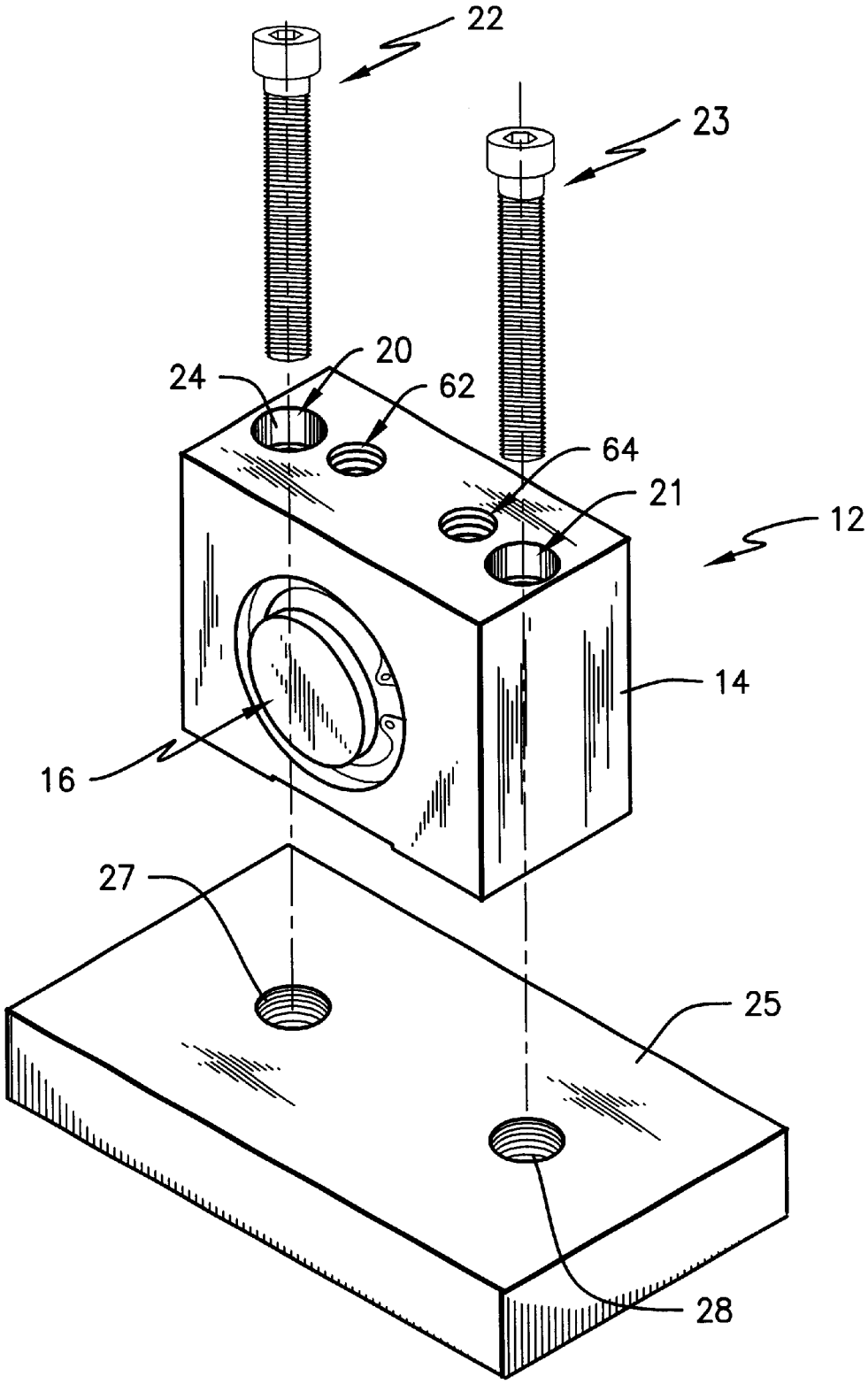
FIG. 1 is an exploded, isometric view showing a typical installation of my new turbine vibrator or motor.

With initial reference directed to FIG. 1 of the appended drawings, my new turbine device has been generally designated by the reference numeral 12. It comprises a rigid, preferably metallic casing 14 that, in the best mode, is configured generally in the form of a rigid parallelepiped. The disclosed monoblock housing design for the vibrator is preferably machined from a solid block of aluminum extrusion with only one opening 13 (FIG. 2) for installation of the rotor assembly.

This rigidity reduces housing flex and therefore noise experienced under high RPM and; force conditions. The housing bore is held closely to the rotor so as to control the airflow within the housing and rotor precisely. To minimize wear on the bearings and reduce noise, the housing is machined so that the bearings supporting the rotor are press fit into it. The disclosed monoblock housing design is preferably machined from a solid block of aluminum extrusion with only one opening 13 for installation of the rotor assembly.

The front orifice 13 (FIG. 2) defined in the casing 14 receives and seats the rotor assembly, generally designated 16 in FIG. 1, to be described in more detail later. Suitable mounting passageways 20, 21 accommodate Allen-head mounting bolts 22, 23 respectively whose drive heads flushly seat within suitable counterbores 24. These bolts secure the device 12 to a typical mounting or application 25. Tapped orifices 27 and 28 in the mounting or application register with casing orifices 20 and 21 to threadably receive bolts 22 and 23 respectively.

Figure 2:
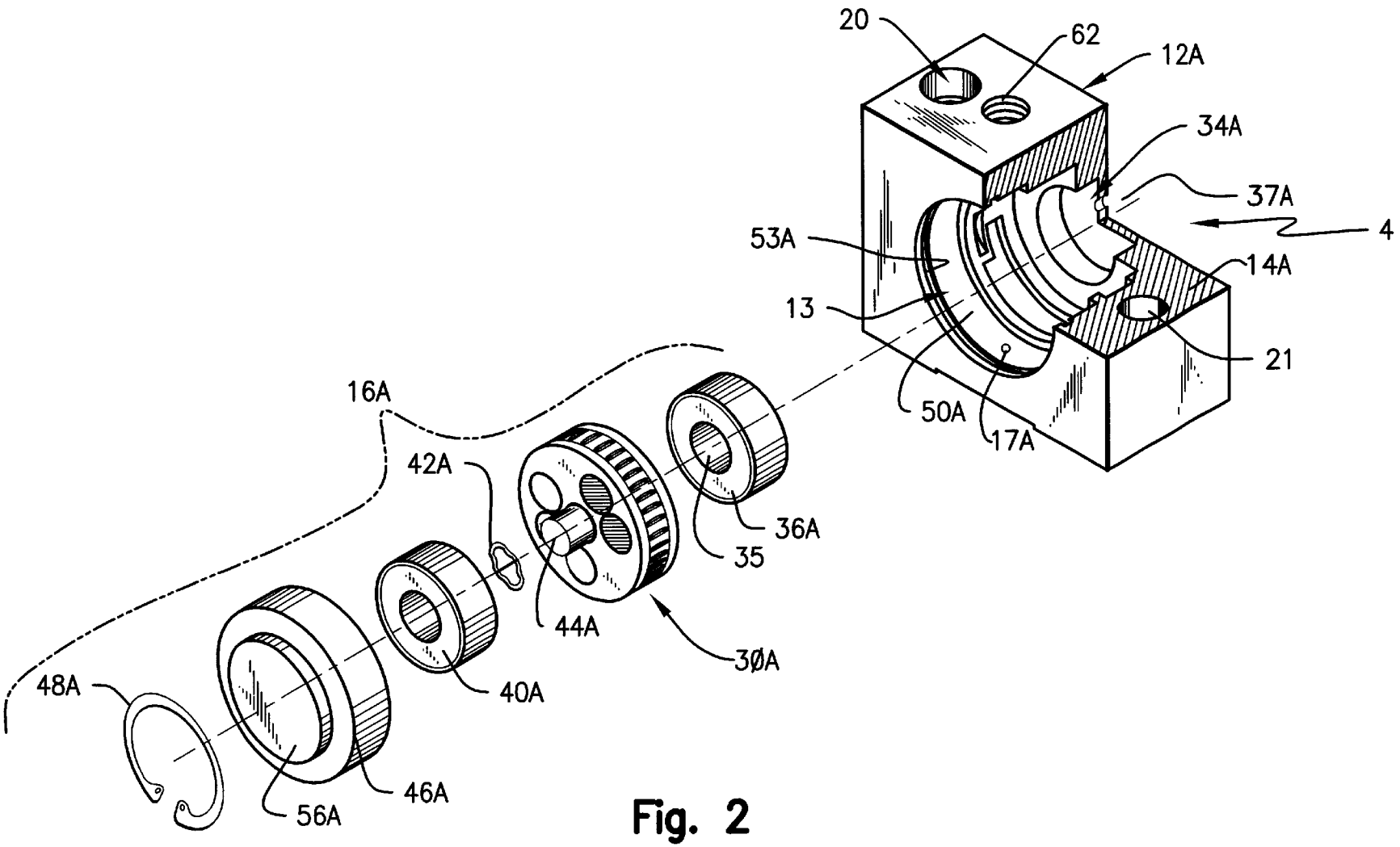
FIG. 2 is an exploded, isometric assembly view of the preferred vibrator.
Figure 3:
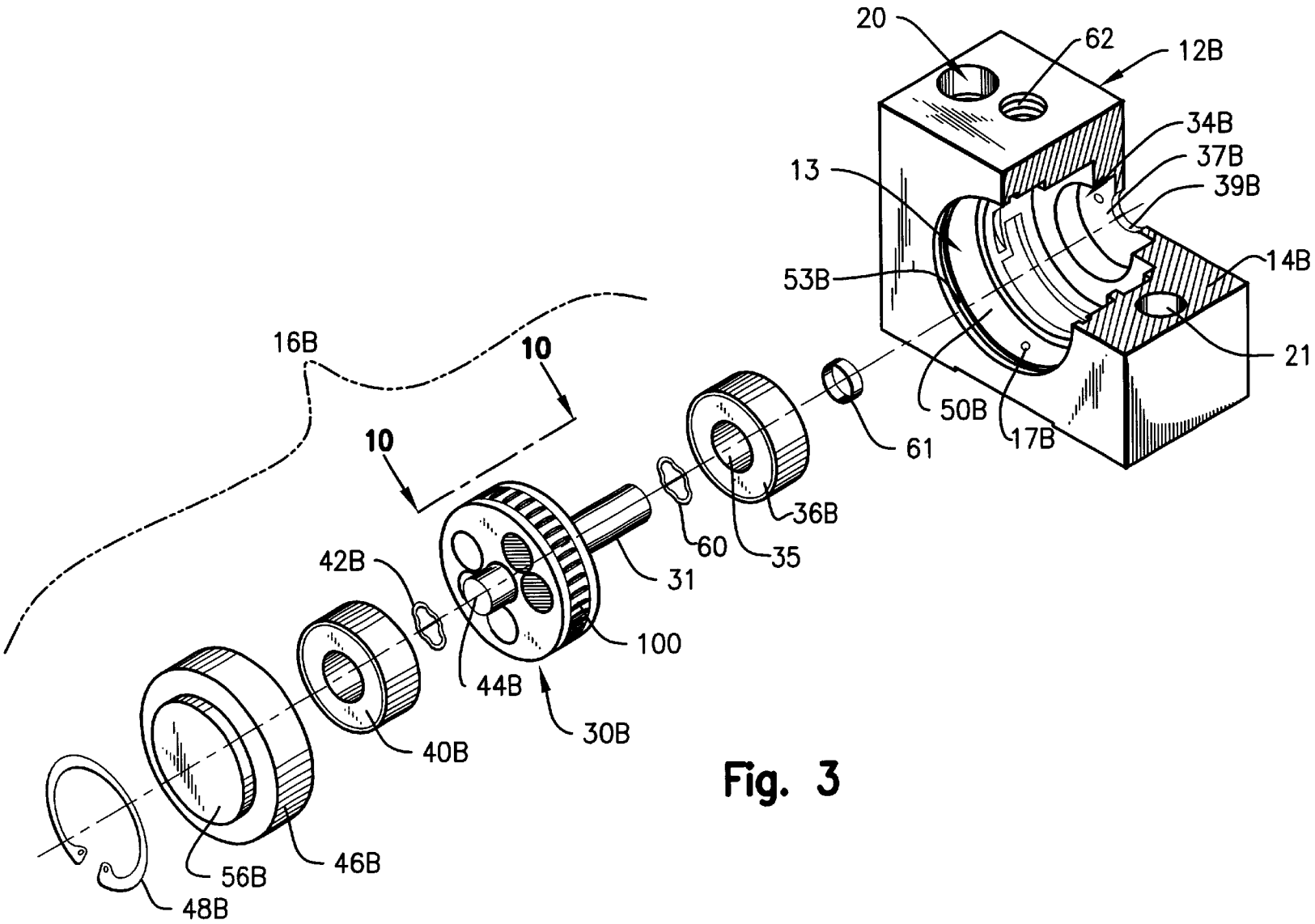
FIG. 3 is an exploded, isometric assembly view of the preferred fluid motor.

In FIG. 2, the device is configured as a pneumatic vibrator, designated with the reference numeral 12A. In FIG. 3 the device 12 has been configured as a rotary fluid motor, designated by the reference numeral 12B. Only minor differences exist between the two applications. The vibrator 12A (FIG. 2), for example, comprises a modified rotor assembly 16A having an unbalanced rotor 30A that has a limited length shaft 44A projecting outwardly from both ends. Casing orifice 34A that receives bearing 36A has a closed sidewall 37A.

The motor 12B, on the other hand, employs a rotor assembly 16B comprising a turbine rotor 30B having an elongated, rearwardly projecting driveshaft 31 (FIG. 3) integral with shaft 44B. Driveshaft 31 penetrates bearing 36B that nests within bearing chamber 34B in casing 14B and the shaft clearance orifice 39B defined in the sidewall 37B of casing 14B (FIG. 3). Numerous devices known to those skilled in the art may be externally interconnected with driveshaft 31 for powering.

The preferred vibrator rotor assembly 16A (FIG. 2) additionally comprises a front bearing 40A that coaxially engages stub shaft 44A projecting from rotor 30A. A suitable spring washer 42A is coaxially sandwiched between bearing 40A and rotor 30A. Bearing 40A is coaxially housed (i.e., press fitted) within bearing cap 46A that is similarly press-fitted within an enlarged diameter annulus 50A in casing 14A that is coaxial with orifice 17A. A hub 56A integral with bearing cap 46A coaxially penetrates and secures snap ring 48A that engages snap groove 53A within casing 14A in assembly (FIG. 2). A companion shaft portion (not shown) integral with shaft portion 44A (FIG. 2) projects from the rear of rotor 30A and penetrates the orifice 35 in bearing 36A. Bearing 36A tightly snaps within orifice 34A adjacent closed sidewall 37A in the casing.

The motor embodiment (FIG. 3) is quite similar. The rotor assembly 16B likewise comprises a front bearing 40B coaxially fitted to driveshaft stub portion 44B projecting from rotor 30B, with intermediate spring washer 42B captivated in between. Bearing 40B is coaxially housed within bearing cap 46B fitted to casing annulus 50B that is coaxial with orifice 17B. Integral hub 56B on bearing cap 46B (FIG. 3) coaxially penetrates snap ring 48B that engages snap groove 53B within casing 14B (FIG. 3). Driveshaft 31, which is integral with shaft portion 44B, penetrates bearing 36B and seal 61. When the rotor assembly 16B is fitted to the casing, i.e., within orifice 17B, bearing 36B presses against sidewall 37B within chamber 34B. Drive shaft 31 penetrates orifice 39B, and is available for connection to an application to be rotationally powered.

Figure 4:
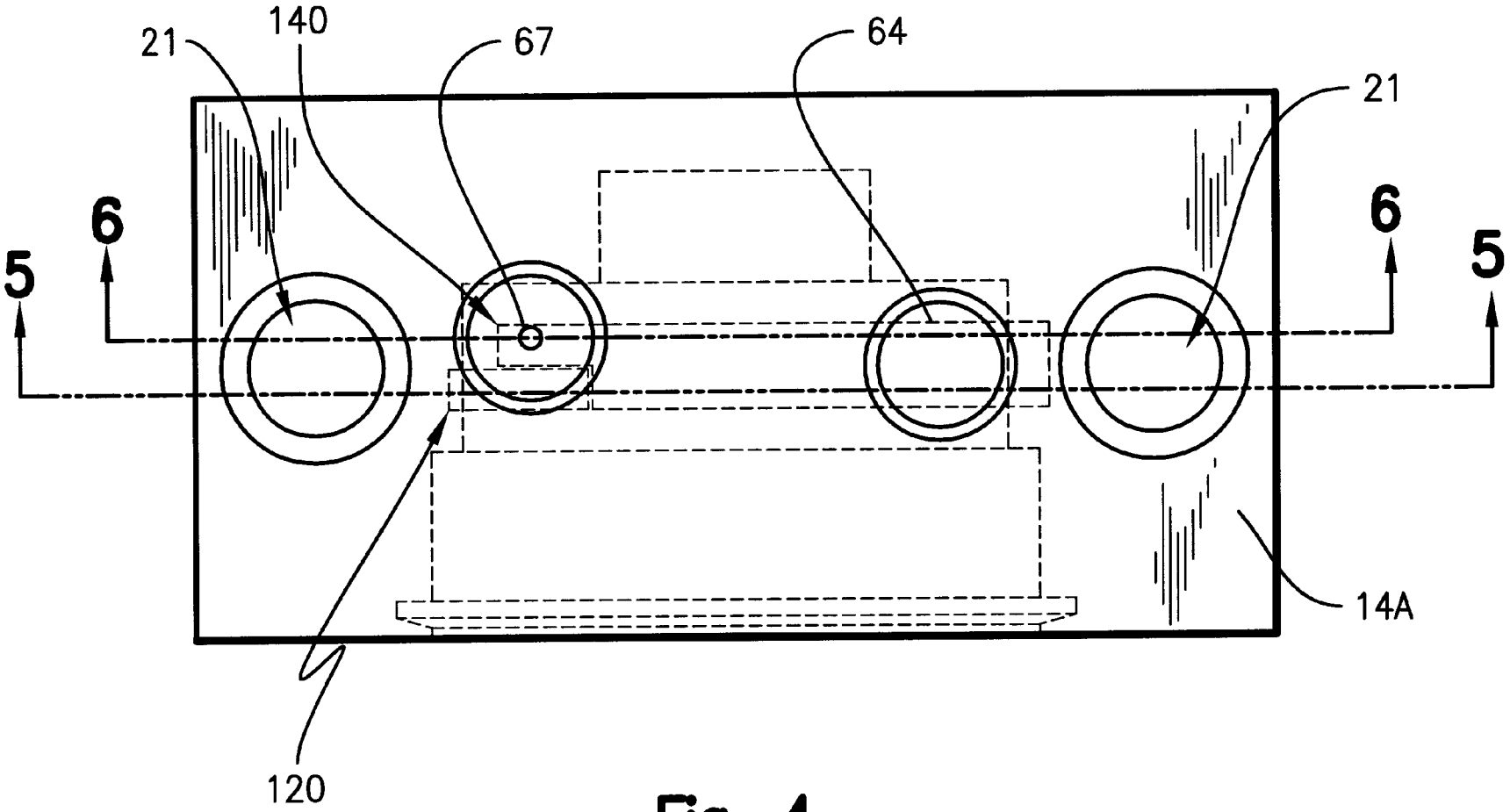
FIG. 4 is an enlarged, top plan view of the preferred vibrator casing with internal portions thereof shown with phantom lines for convenience.
Figure 5:
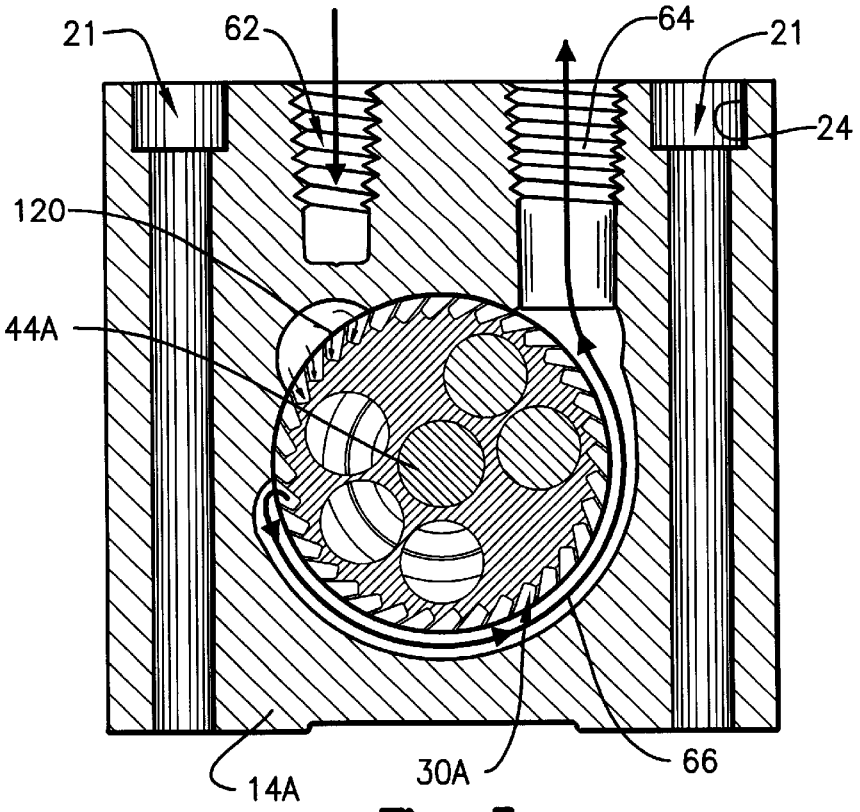
FIG. 5 is a sectional view taken generally along line 5—5 in FIG. 4.
Figure 6:
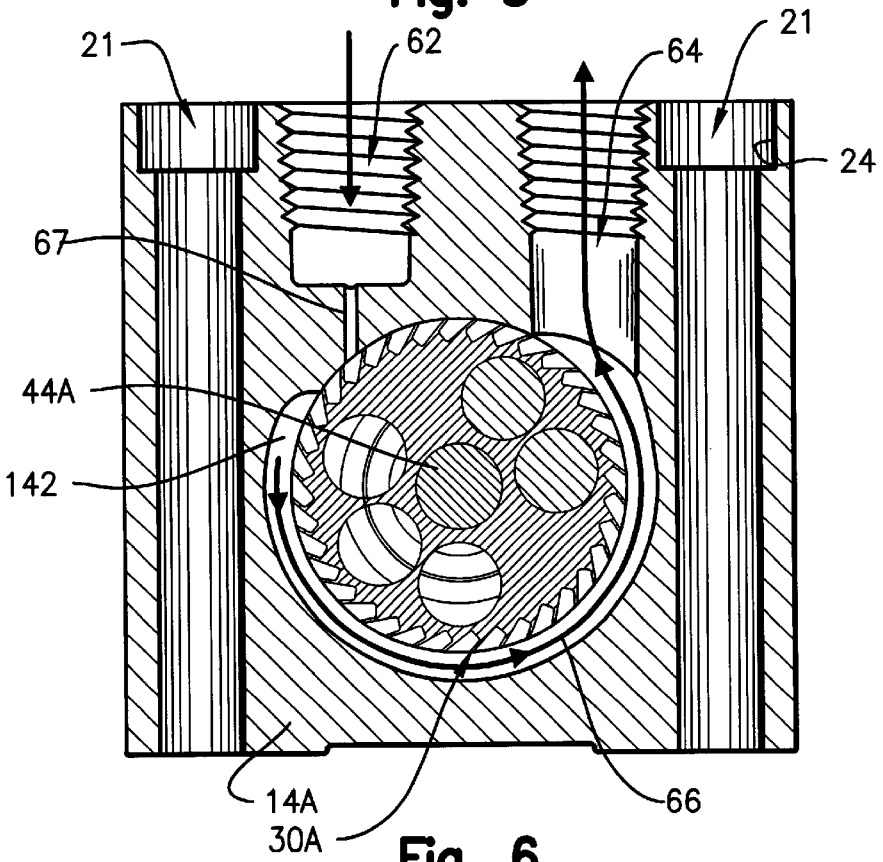
FIG. 6 is a sectional view taken generally along line 6—6 in FIG. 4.

FIGS. 4–6 show internal air path details of the preferred vibrator. FIGS., 7–9 are quite similar, showing the internal air path details of the preferred motor. In both cases a suitable air inlet fitting (not shown) is coupled to threaded inlet bore 62, and a suitable pneumatic muffler that disperses air (not shown) is coupled to threaded outlet bore 64. An air path through the casing 14A has been generally designated by the circular line 66 (FIGS. 5, 6) that comprises arrowheads indicating the flow direction.

Figure 7:
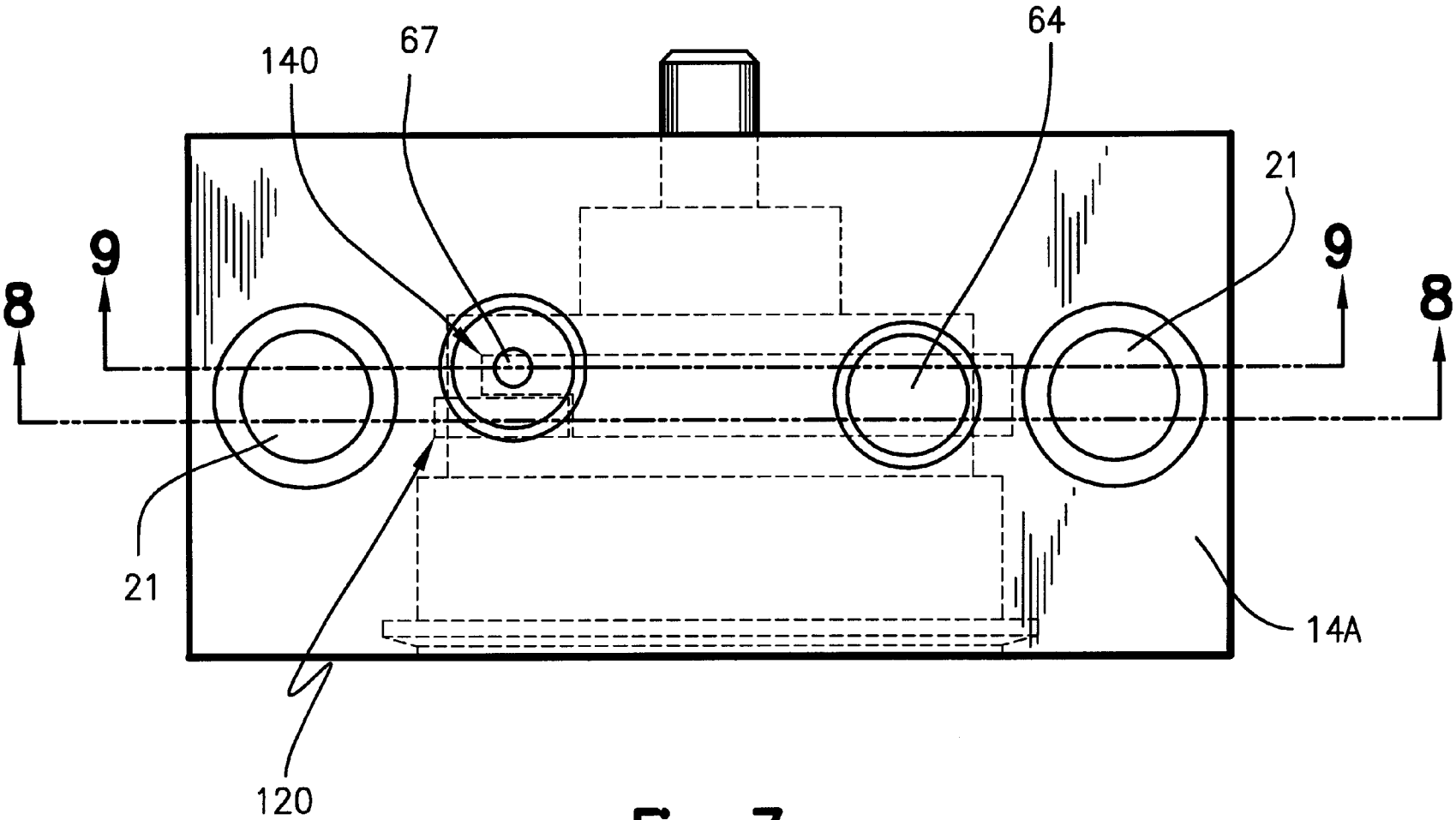
FIG. 7 is an enlarged, top plan view of the preferred motor casing with internal portions thereof shown with phantom lines for convenience.
Figure 8:
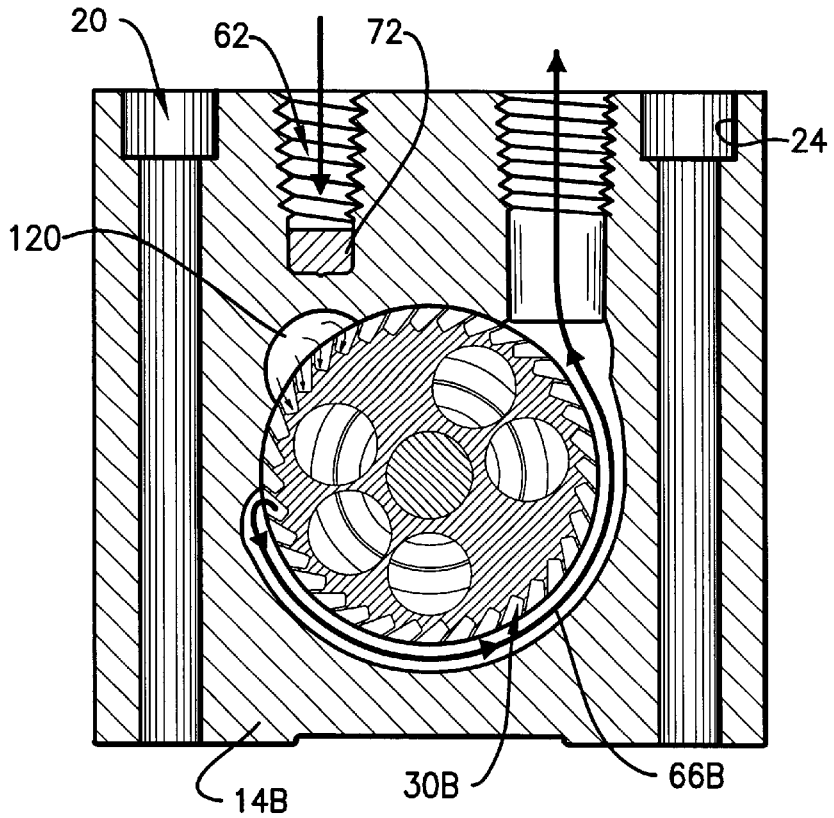
FIG. 8 is a sectional view taken generally along line 8—8 in FIG. 7.
Figure 9:
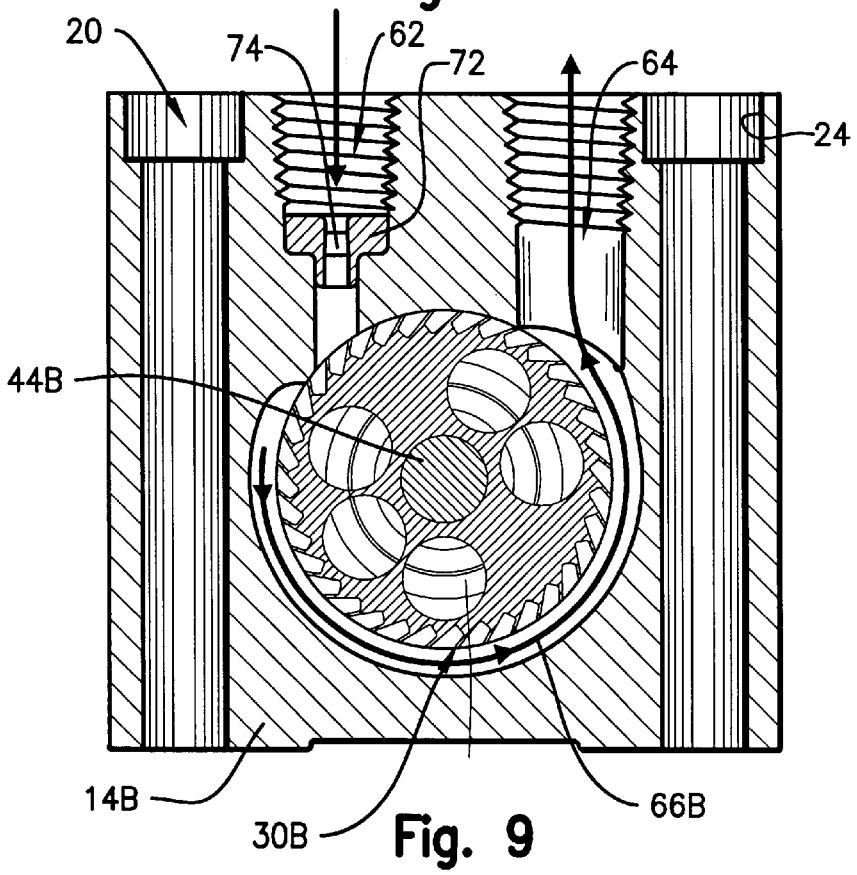
FIG. 9 is a sectional view taken generally along line 9—9 in FIG. 7.
Figure 12:
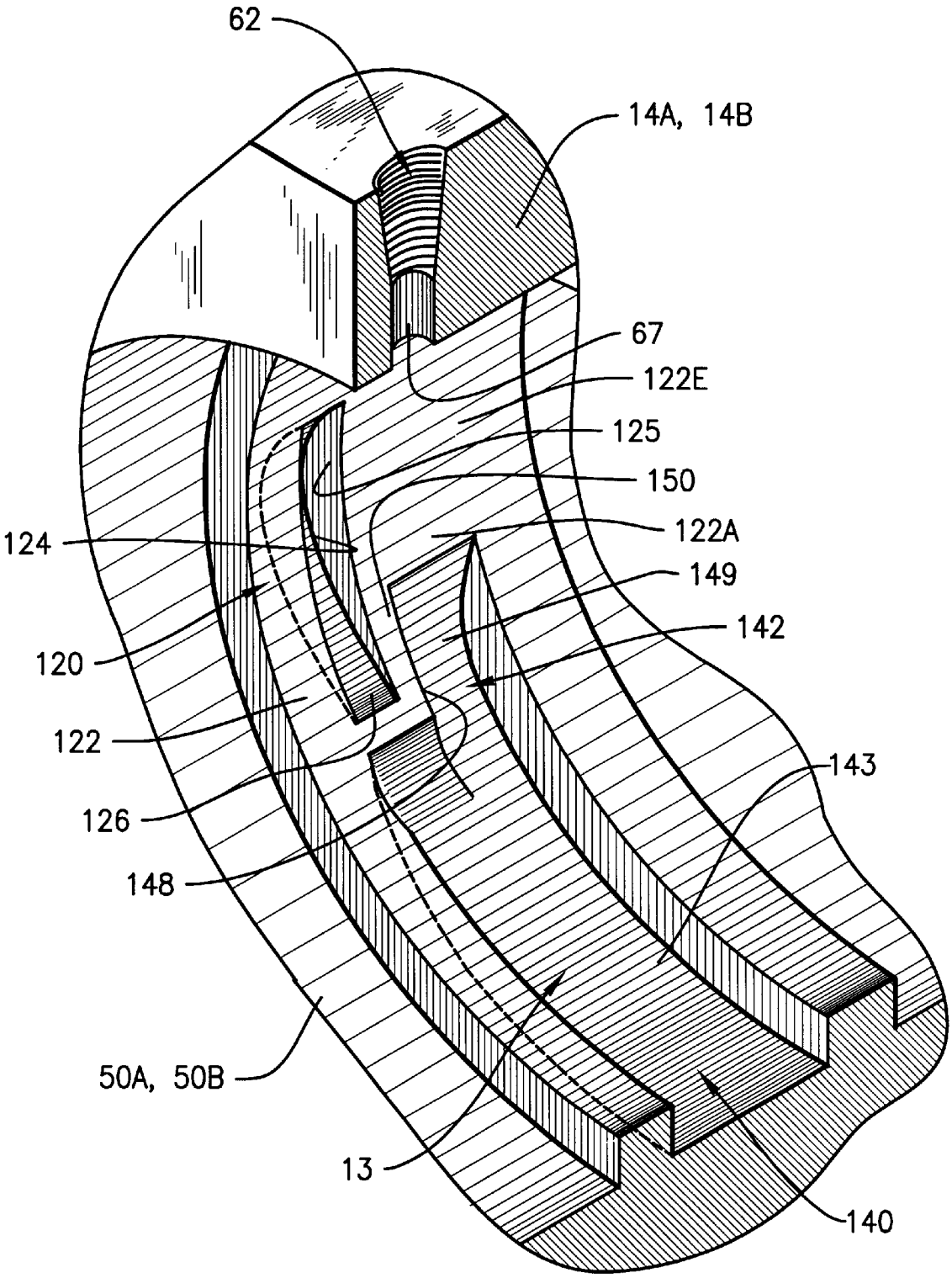
FIG. 12 is an enlarged, fragmentary oblique view of the interior of the motor casing used with both the vibrator and the motor, showing the preferred exhaust groove and reentry port.

The reduced diameter passageway 67 (FIGS. 5, 12) in fluid flow communication with bore 62 conducts pressurized air to the casing interior and establishes air path 66. Preferably the width (i.e., diameter) of a typical rotor bucket is approximately 3.25 times the width (i.e., diameter) of passageway 67. In the preferred motor structure of FIGS. 7–9 the air inlet bore 62 threadably receives a generally tubular, supersonic jet fitting 72 of the type recognized by those with skill in the art. The internal passageway is contoured to insure supersonic flow at higher air pressures, according to principles well known in the fluid mechanics arts. Nevertheless the width of a typical rotor bucket is approximately 3.25 times the width the inlet set passageway 67 (FIG. 12).

Restrictor passageway 74, that is in fluid communication with passageway 67 discussed previously, restricts the air flow volume and increases momentum applied to rotor 30B. Obtainable RPM varies with model and rotor size, and rotor speeds of between 17,000 to 50,000 RPM have been obtained experimentally. A modified air flow path through the motor casing 14B has been generally designated by the circular line 66B (FIGS. 8, 9) that comprises arrowheads indicating the flow direction, terminating in travel through a suitable conventional pneumatic muffler (not shown) threaded to bore 64.

The rotor is specially configured to work properly in conjunction with the casing design to be explained hereinafter. The rotor periphery is the same in the vibrator mode or in the fluid motor mode. For example, with joint reference to FIGS. 3, 10 and 11, the outer, radial periphery designated by the numeral 100 comprises a plurality of radially, spaced-apart buckets 101. Each bucket is physically separated from adjoining buckets by a wall 102. Each bucket is located between the larger, disk-like ends 97, 98 on opposite ends of the generally cylindrical rotor.

Figure 10:
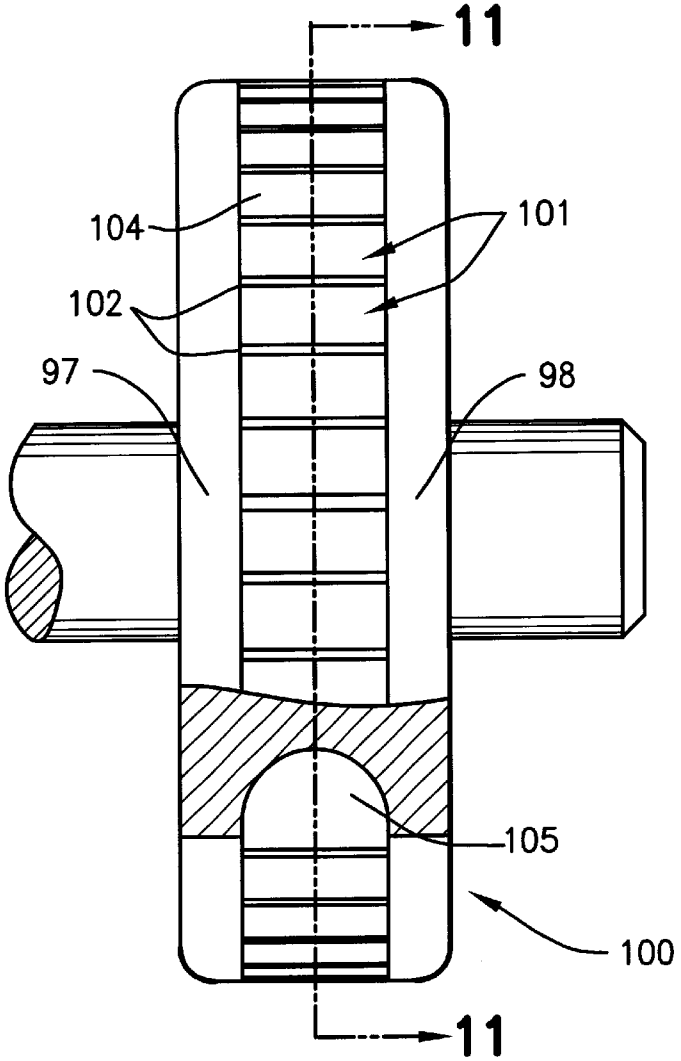
FIG. 10 is an enlarged, fragmentary elevational view of the preferred rotor wheel bucket construction, taken generally along line 10—10 in FIG. 3.

The top face area 105 of each wall is semicircular; the bottom face area 103 of each wall is also semicircular, but reduced in dimension (FIG. 10). The innermost wall 104 at the inside of the bucket between a pair of walls 102 is arcuate; air entering one side of the bucket is vigorously redirected out the other side by the curved wall 104. The outermost radial surfaces of rotor ends 97, 98 are flush with the outer surfaces of walls 102. This construction ensures a substantially airtight seal whenever the moving buckets temporarily face smooth metal portions of the adjoining chamber.

Figure 11:
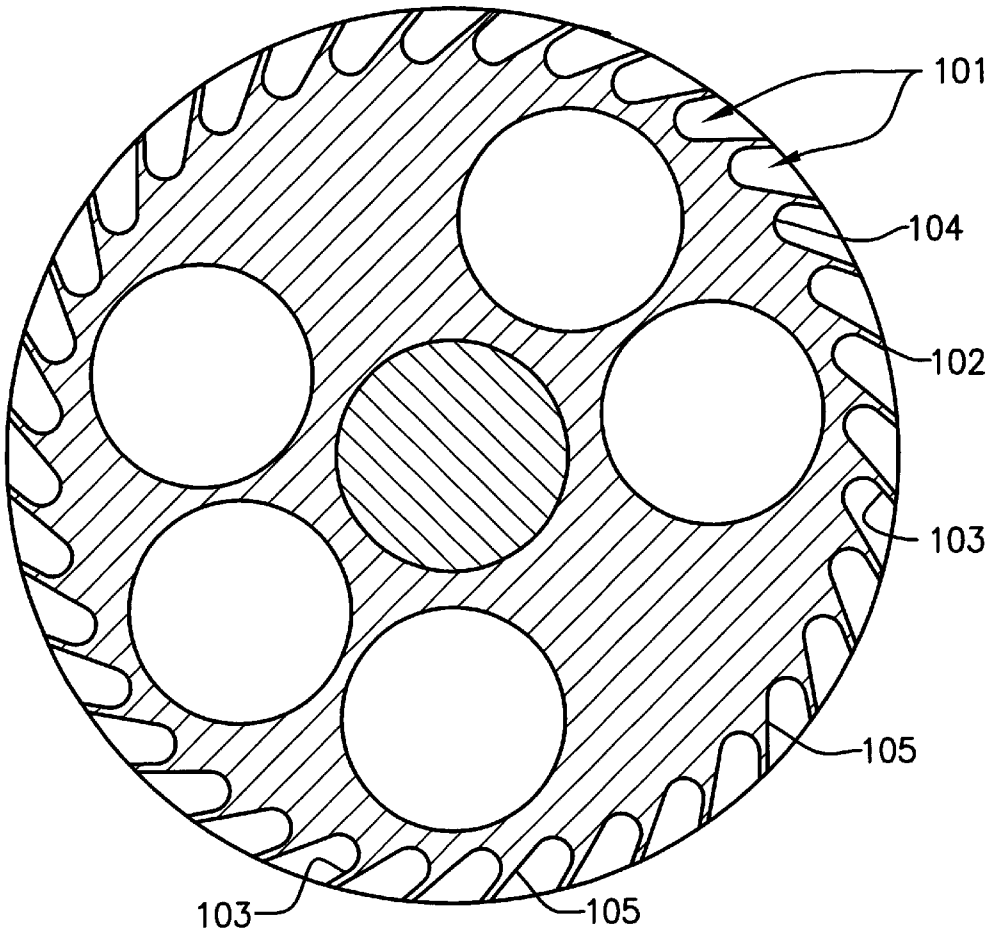
FIG. 11 is an enlarged, fragmentary sectional view of the preferred rotor wheel bucket construction, taken generally along line 11—11 in FIG. 10.

With additional reference to FIG. 11, each bucket is of generally rectangular dimensions. The walls 102 separating adjacent buckets 101 are inclined approximately 45 degrees from a hypothetical radius extending outwardly from the rotor center that perpendicularly intersects the rotor periphery adjacent the bucket. Since the lowermost floor 104 (FIGS. 10, 11) in each bucket is curved, when air is first directed to a bucket through the passageway 67 (FIG. 4, 5 or 12), it's natural path of travel is to turn around the corner and redirect itself outwardly.

The aforesaid rotor and bucket construction relates to the important reentry port and exhaust gas portion to be now described. The preferred construction is best understood by concurrent reference to FIGS. 8–14. Turning first to FIG. 12, a reentry port 120 has been defined in the race portion 122 of casing 14A or 14B that houses the rotor. Reentry port 120 is defined between a pair of spaced apart, half-tear-shaped walls 125 and 124, and a lower, arcuate floor 126. The floor 126 is arc-shaped near the inlet port 67 (FIG. 12) but it gradually and flushly abuts the inner surface regions 122A of race 122 to form a gradual transition. Of the 360 degree extent of the race 122, the reentry port assumes approximately thirty-five degrees of arc (i.e., if measured with a protractor in FIG. 8). The reentry port 120 is laterally and radially offset away from port 67.

The main exhaust groove 140 is wider and longer than the reentry port 120. Groove 140 occupies approximately 240 to 260 degrees of arc. Groove 140 extends 250 degrees radially in the best mode. The exhaust groove 140 has a portion bordering the reentry port 120. Preferably groove 140 begins in a reduced width, neck portion 142, that is in fluid communication with main body portion 143 (FIG. 12). A notch 148 results at the corner intersection between the neck 142 and the main exhaust groove body. This narrow neck portion 142 occupies approximately five to ten degrees of arc around the inner race perimeter. Preferably it radially extends approximately seven degrees. Further, there is an important dividing wall, or septum 150 rigidly defined between reentry port 120 and exhaust neck 142. The arced end surface 149 adjacent the neck 142 smoothly transitions to be flush with race surface 122A (FIG. 12). Similarly, the arced end surface 149 of the neck 142 smoothly transitions with the exposed race surface. Importantly, there is a flush race surface 122E immediately to the right of reentry port 120 (as viewed in FIG. 12.) Surface region 122E is immediately upstream from the reduced width exhaust neck 142.

It is to be appreciated that, after assembly, the smooth, and precision race surfaces 122, 122A, and 122E discussed above are spaced apart only slightly from the outer periphery of the rotor, such that exposed outermost surfaces of rotor walls 109 and rotor sides 102, 104 (FIGS. 10, 11) are preferably spaced in the order of 0.1 millimeter from the race to maintain a proper seal. This means that the diameter of the rotor-receptive race within the casing is only about 0.2 millimeters greater than the diameter of the rotor. When facing unmachined portions of the race, the buckets are thus sealed.

Figure 13:
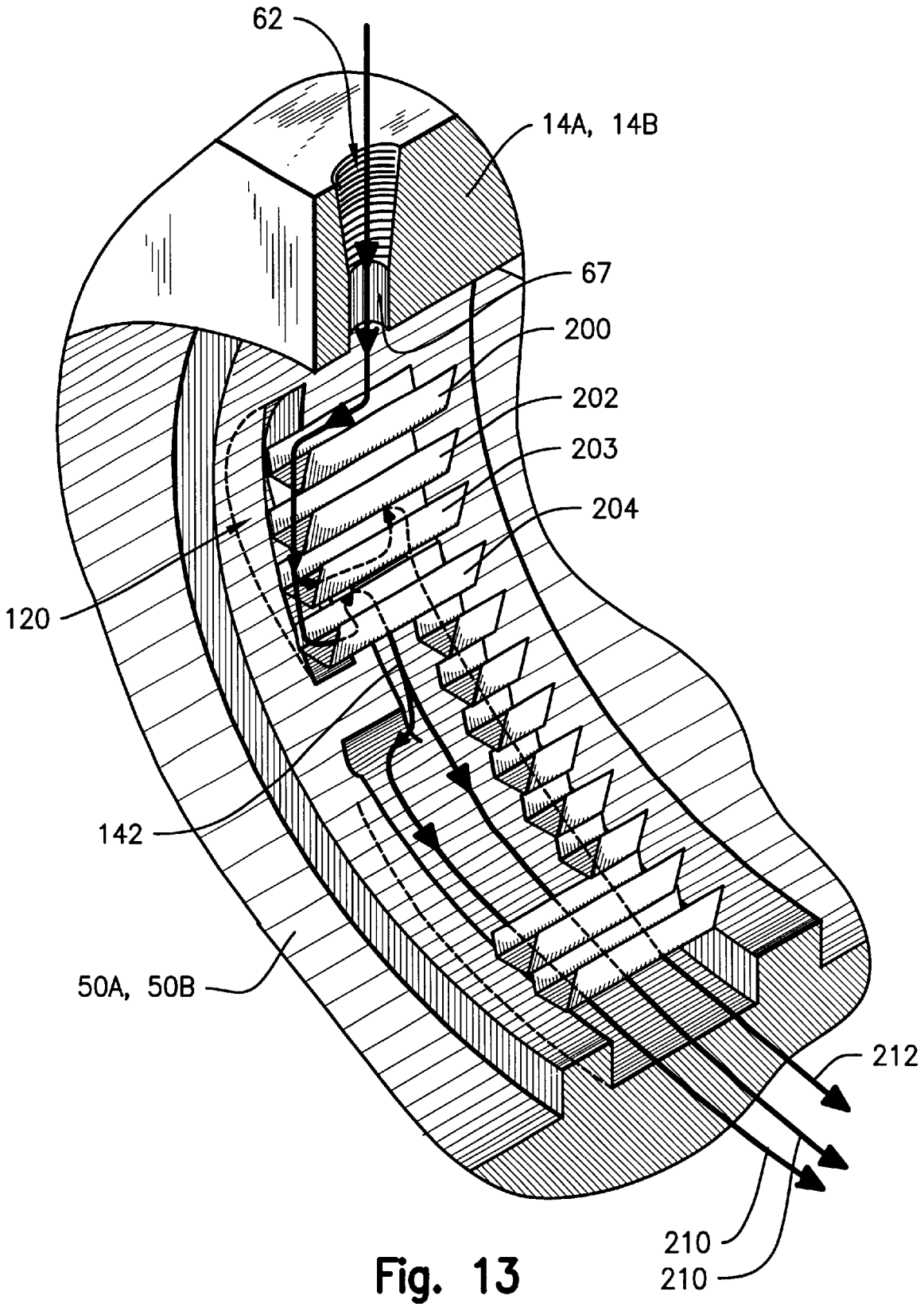
Figure 14:
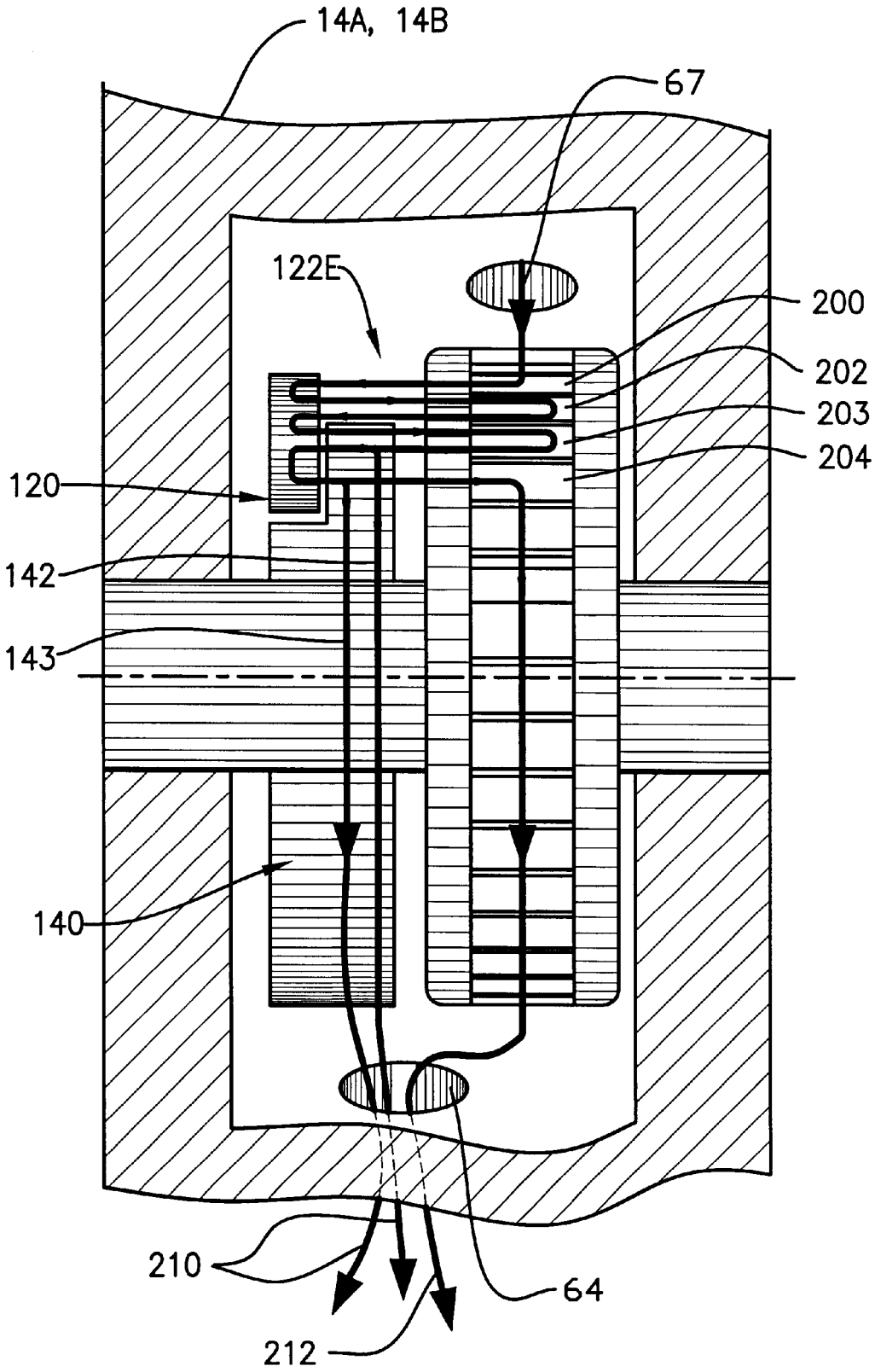
FIG. 14 is a fragmentary, pictorial view depicting rotor bucket positions and the resultant air path, with the rotor shown in a non-functional, hypothetical position shifted to the right to expose the reentry port and the exhaust port that would otherwise be occluded in assembly.

Operation is best understood by a comparison of FIGS. 12–14. In FIG. 14 an effort has been made to designate the air path, without occluding the reentry ports and the exhaust gas louver by placing the rotor above it. In FIG. 13 portions of the rotor are shown in fragmentary form in an effort to discern the circular air path for making this system run. Air enters through port 67, and is directed upon one of the rotating buckets 105 defined in the rotor periphery. In FIG. 14, for explanation purposes only, the first bucket hit by the airflow, at a moment frozen in time, has been designated by the reference number 200. Airflow is redirected through the bucket 200 by its curved floor 104 (FIG. 11). At this point in time, approximately half of the width of bucket 200 overlies the reentry port 120 and the other half overlies race surface region 122E. The same is true with next succeeding downstream bucket 202—half of it strides the reentry port but the other half is substantially sealed above region 122E (FIG. 14). Slight air pressure reaches the interior of second bucket 202 but air cannot escape into the exhaust port 140 or neck 142. The first and second buckets are thus a class of buckets that half overlie the reentry port, and half overlie the unmachined, smooth surface of the outer race.

At the same instant in time, however, approximately half of the width of third and fourth buckets 203 and 204 respectively overlies the reentry port 120. But concurrently the other half of the width of buckets 203, 204 overlies the reduced width neck portion 142 of the exhaust port 140. Buckets 203, and 204 are members of a second class of buckets, that half overly the reentry port and half overly the exhaust port neck. Thus air is primarily routed through the reentry port 120 by the first bucket 200, resulting in pressure upon the first bucket that tends to rotate the rotor. But air is immediately delivered into the third and fourth buckets from the reentry port as well. However such air is not redirected into the reentry port—it is discharged into the exhaust groove 140 via the neck 142, as the third and fourth buckets also overly neck 142 at this time.

As the effective width of the exhaust port increases, i.e. downstream from notch 148 (FIG. 12), the increased air volume lowers speed and facilities quieting. Furthermore, as apparent from the air path arrows 210 and 212, gases exhausting through groove 140 rushing about the periphery of the race also pressure rotor buckets that are substantially downstream. Buckets succeeding buckets 203 and 204 are members of a third class of buckets, that overly the entire exhaust port. This most numerous third class of buckets is best seen, for example, in FIG. 5, adjoining the air path 66 that extends from the beginning of the full-width exhaust port to the outlet 64. A final, fourth class of buckets adjoins unmachined race surface area. These buckets do not border any relief groove, reentry port or exhaust port. Class four buckets are seen at the top of the rotor in FIG. 5, between the inlet 62 and outlet 64.

In the best mode, the rotor will contain as many buckets as possible and maintain a bucket height sufficient to contain the entire inlet jet output. For the typical vibrator rotor, that is approximately 5 cm. in diameter and 1.5 cm. thick, the number of buckets is 36. This number can vary depending upon the size of the rotor. The rotor is balanced in the motor embodiment, but unbalanced by use of pressed-in weights in the vibrator version. The rotor is mounted on a press-fit, one-piece shaft to guarantee concentricity between the shaft ends. Based upon present knowledge from my recent experiments, in the best mode the bucket diameter will be about 3.25 times the diameter of port 67, or the diameter 67E (FIG. 9) of the jet nozzle. The depth of the buckets will be such so as to maintain as close to a half circle form as possible; i.e., inner bucket walls 104 (FIG. 11) are curved. The buckets will thus turn the air stream directed to one side 180 degrees. Preferably each bucket is machined in a two step process that maintains the floor of one bucket parallel with the roof of the following bucket. The housing takes the form of a parallelepiped for the sake of rigidity.

The airflow passes through a discrete bucket and rather than exhausting the still high velocity air, it is returned to the rotor via a reentry port and passed back through the buckets so more residual energy may be extracted. Operating pressure ranges from 5 psig. to 100 psig. for the vibrator. The motor version can handle higher pressures. Rotor diameter, bucket number, bucket design, jet design, and air control are all closely controlled to optimize performance and efficiency while maintaining OSHA noise compliance.

From the foregoing, it will be seen that this invention is one well adapted to obtain all the ends and objects herein set forth, together with other objects and advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A rotary pneumatic power device for use as an air motor or vibrator, said device comprising:

a rigid casing;

a circular race internally defined in the casing;

a rotor disposed coaxially within said race, the rotor comprising a plurality of radially spaced apart buckets;

an air inlet;

a reentry port offset from said inlet;

an air outlet;

an exhaust port defined in said race providing fluid flow communication to said outlet, the exhaust port comprising a portion laterally spaced apart from said reentry port; and, an air path extending between said inlet and said outlet and through the exhaust port that develops substantial pressure on said buckets to rotate said rotor.

2. The device as set forth in claim 1 wherein the exhaust port comprises a major portion with a predetermined width and a neck portion with a reduced width, at least a portion of the length of said neck laterally being spaced apart from said reentry port and separated therefrom by a septum.

3. The device as set forth in claim 1 wherein, at a given moment in time, at least an initial one of said buckets is positioned in fluid flow communication with the air inlet, half the initial bucket overlies the reentry port, and the other half of the initial bucket overlies a neighboring unmachined portion of the race.

4. The device as set forth in claim 3 wherein, at a given moment in time, at least one of the succeeding buckets downstream from said initial bucket half overlies the reentry port, and half overlies a portion of the exhaust port, and thus establishes fluid flow communication between said reentry port and said exhaust port.

5. The device as set forth in claim 4 wherein a plurality of the buckets downstream from said succeeding bucket completely overlie said exhaust port.

6. The device as set forth in claim 1 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

7. The device as set forth in claim 6 wherein all of the buckets are sealed when they adjoin unmachined portions of the race.

8. The device as set forth in claim 6 wherein:

the race establishes 360 degrees of arc;

the reentry port occupies approximately 30 to 40 radial degrees of arc; and, the exhaust port occupies approximately 230 to 260 radial degrees of arc.

9. The device as set forth in claim 6 wherein each bucket occupies approximately ten degrees of arc.

10. The device as set forth in claim 9 wherein the reentry port is long enough to border at least four consecutive buckets.

11. The device as set forth in claim 1 wherein the buckets have a predetermined diameter, and the inlet has an inlet port with a predetermined diameter, and the diameter of the buckets is approximately 3.25 times the diameter of the inlet port.

12. A rotary pneumatic power device for use as an air motor or vibrator, said device comprising:

a rigid casing;

a circular race internally defined in the casing;

a rotor disposed coaxially within said race and comprising a periphery with a plurality of radially spaced apart buckets;

an air inlet;

a reentry port laterally offset from said inlet, said reentry port bordering an unmachined surface portion of said race;

an air outlet;

an exhaust port defined in said race providing fluid flow communication to said outlet, the exhaust port comprising a major portion with a predetermined width and a smaller neck portion with a reduced width, at least a portion of the length of said reduced width neck portion laterally spaced apart from said reentry port and separated therefrom by a septum; and, an air path extending between said inlet and said outlet that develops substantial pressure on said buckets to rotate said rotor; and wherein:

incoming air impinging against a first bucket temporarily disposed adjacent said inlet is redirected by said first bucket to said reentry port;

air passing through said reentry port enters a second bucket and pressures said rotor, but cannot reach said exhaust port through said second bucket and instead is returned into said reentry port;

air passing through said reentry port enters third and fourth buckets downstream from said first and second buckets through sides of said third and fourth buckets overlying said reentry port, and is directed from said third and fourth buckets into said exhaust port neck that is bordered by opposite sides of said third and fourth buckets at this time; and, air escaping said reentry port through said third and fourth buckets travels about the periphery of said rotor within said exhaust port and vents through said outlet.

13. The device as set forth in claim 12 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

14. The device as set forth in claim 13 wherein:

the race establishes 360 degrees of arc;

the reentry port occupies approximately 30 to 40 radial degrees of arc; and, the exhaust port occupies approximately 230 to 260 radial degrees of arc.

15. The device as set forth in claim 12 wherein all of the buckets are sealed when they adjoin unmachined portions of the race.

16. A rotary pneumatic power device for use as an air motor or vibrator, said device comprising:

a rigid casing;

a circular race of 360 degrees arc internally defined in the casing;

a rotor disposed within the casing coaxially within said race and comprising a 360 degree periphery with a plurality of radially spaced apart buckets and an inner shaft having opposed ends;

a first bearing press fitted into the casing and engaging one end of said shaft to support the rotor;

a bearing cap adapted to be press fitted to said casing, the cap comprising a hub adapted to be secured by a snap ring for completing the assembly;

a second bearing coaxially engaging an opposite end of said shaft to support the rotor, said bearing press fitted into said bearing cap;

an air inlet;

a reentry port laterally offset from said inlet;

an air outlet;

an exhaust port defined in said race providing fluid flow communication to said outlet, the exhaust port comprising a portion bordering said reentry port but separated therefrom; and, an air path extending between said inlet and said outlet that develops substantial pressure on said buckets to rotate said rotor.

17. The device as set forth in claim 16 wherein each bucket is physically defined between disk-like ends of the rotor, and separated from adjoining buckets by a wall having a semi-circular top face and bottom face.

18. The device as set forth in claim 16 wherein said walls separating adjacent buckets are inclined approximately 45 degrees from a hypothetical radius extending outwardly from the rotor center that perpendicularly intersects the rotor periphery adjacent the bucket.

19. The device as set forth in claim 17 wherein each bucket comprises an innermost curved wall, so air entering one side of the bucket is vigorously redirected out the other side by the curved wall.

20. The device as set forth in claim 17 wherein the outermost radial surfaces of the disk-like rotor ends are flush with the outermost surfaces of said walls to ensure a substantially airtight seal whenever the moving buckets temporarily face smooth, unmachined portions of the adjoining race.

21. The device as set forth in claim 17 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

22. The device as set forth in claim 21 wherein:

the reentry port is approximately 30 to 40 radial degrees of arc; and, the exhaust port is approximately 230 to 260 radial degrees of arc.

23. The device as set forth in claim 22 wherein all of the buckets are sealed when they adjoin unmachined portions of the race.

24. A pneumatic vibrator comprising:

a rigid casing;

a circular race internally defined in the casing;

a rotor disposed coaxially within said race, the rotor comprising a plurality of radially spaced apart buckets;

an air inlet;

a reentry port offset from said inlet;

an air outlet;

an exhaust port defined in said race providing fluid flow communication to said outlet, the exhaust port comprising a portion laterally spaced apart from said reentry port; and, an air path extending between said inlet and said outlet and through the exhaust port that develops substantial pressure on said buckets to rotate said rotor.

25. The vibrator as set forth in claim 24 wherein the exhaust port comprises a major portion with a predetermined width and a neck portion with a reduced width, at least a portion of the length of said neck laterally being spaced apart from said reentry port and separated therefrom by a septum.

26. The vibrator as set forth in claim 24 wherein, at a given moment in time, at least an initial one of said buckets is positioned in fluid flow communication with the air inlet, half the initial bucket overlies the reentry port, and the other half of the initial bucket overlies a neighboring unmachined portion of the race.

27. The vibrator as set forth in claim 26 wherein, at a given moment in time, at least one of the succeeding buckets downstream from said initial bucket half overlies the reentry port, and half overlies a portion of the exhaust port, and thus establishes fluid flow communication between said reentry port and said exhaust port.

28. The vibrator as set forth in claim 27 wherein a plurality of the buckets downstream from said succeeding bucket completely overlie said exhaust port.

29. The vibrator as set forth in claim 24 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

30. The vibrator as set forth in claim 29 wherein all of the buckets are sealed when they adjoin unmachined portions of the race.

31. The vibrator as set forth in claim 29 wherein:

the race establishes 360 degrees of arc;

the reentry port occupies approximately 30 to 40 radial degrees of arc; and, the exhaust port occupies approximately 230 to 260 radial degrees of arc.

32. The vibrator as set forth in claim 29 wherein each bucket occupies approximately ten degrees of arc.

33. The vibrator as set forth in claim 32 wherein the reentry port is long enough to border at least four consecutive buckets.

34. The vibrator as set forth in claim 24 wherein the buckets have a predetermined diameter, and the inlet has an inlet port with a predetermined diameter, and the diameter of the buckets is approximately 3.25 times the diameter of the inlet port.

35. A pneumatic power vibrator comprising:

a rigid casing;

a circular race internally defined in the casing;

a rotor disposed coaxially within said race and comprising a periphery with a plurality of radially spaced apart buckets;

an air inlet;

a reentry port laterally offset from said inlet, said reentry port bordering an unmachined surface portion of said race;

an air outlet;

an exhaust port defined in said race providing fluid flow communication to said outlet, the exhaust port comprising a major portion with a predetermined width and a smaller neck portion with a reduced width, at least a portion of the length of said reduced width neck portion laterally spaced apart from said reentry port and separated therefrom by a septum; and, an air path extending between said inlet and said outlet that develops substantial pressure on said buckets to rotate said rotor; and wherein:

incoming air impinging against a first bucket temporarily disposed adjacent said inlet is redirected by said first bucket to said reentry port;

air passing through said reentry port enters a second bucket and pressures said rotor, but cannot reach said exhaust port through said second bucket and instead is returned into said reentry port;

air passing through said reentry port enters third and fourth buckets downstream from said first and second buckets through sides of said third and fourth buckets overlying said reentry port, and is directed from said third and fourth buckets into said exhaust port neck that is bordered by opposite sides of said third and fourth buckets at this time; and, air escaping said reentry port through said third and fourth buckets travels about the periphery of said rotor within said exhaust port and vents through said outlet.

36. The vibrator as set forth in claim 35 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

37. The vibrator as set forth in claim 35 wherein:

the race establishes 360 degrees of arc;

the reentry port occupies approximately 30 to 40 radial degrees of arc; and, the exhaust port occupies approximately 230 to 260 radial degrees of arc.

38. The vibrator as set forth in claim 35 wherein all of the buckets are sealed when they adjoin unmachined portions of the race.

39. A rotary pneumatic vibrator comprising:

a rigid casing;

a circular race of 360 degrees arc internally defined in the casing;

a rotor disposed within the casing coaxially within said race and comprising a 360 degree periphery with a plurality of radially spaced apart buckets and an inner shaft having opposed ends;

a first bearing press fitted into the casing and engaging one end of said shaft to support the rotor;

a bearing cap adapted to be press fitted to said casing, the cap comprising a hub adapted to be secured by a snap ring for completing the assembly;

a second bearing coaxially engaging an opposite end of said shaft to support the rotor, said second bearing press fitted into said bearing cap;

an air inlet;

a reentry port laterally offset from said inlet;

an air outlet;

an exhaust port defined in said race providing fluid flow communication to said outlet, the exhaust port comprising a portion bordering said reentry port but separated therefrom; and, an air path extending between said inlet and said outlet that develops substantial pressure on said buckets to rotate said rotor.

40. The vibrator as set forth in claim 39 wherein each bucket is physically defined between disk-like ends of the rotor, and separated from adjoining buckets by a wall having a semi-circular top face and bottom face.

41. The vibrator as set forth in claim 40 wherein said walls separating adjacent buckets are inclined approximately 45 degrees from a hypothetical radius extending outwardly from the rotor center that perpendicularly intersects the rotor periphery adjacent the bucket.

42. The vibrator as set forth in claim 40 wherein each bucket comprises an innermost curved wall, so air entering one side of the bucket is vigorously redirected out the other side by the curved wall.

43. The vibrator as set forth in claim 40 wherein the outermost radial surfaces of the disk-like rotor ends are flush with the outermost surfaces of said walls to ensure a substantially airtight seal whenever the moving buckets temporarily face smooth, unmachined portions of the adjoining race.

44. The vibrator as set forth in claim 40 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

45. The vibrator as set forth in claim 44 wherein:

the reentry port is approximately 30 to 40 radial degrees of arc; and, the exhaust port is approximately 230 to 260 radial degrees of arc.

46. The vibrator as set forth in claim 45 wherein all of the buckets are sealed when they adjoin unmachined portions of the race.

47. A pneumatic motor comprising:

a rigid casing;

a circular race internally defined in the casing;

a rotor disposed coaxially within said race, the rotor comprising a plurality of radially spaced apart buckets and a driveshaft projecting from said casing;

an air inlet;

a reentry port offset from said inlet;

an air outlet;

an exhaust port defined in said race providing fluid flow communication to said outlet, the exhaust port comprising a portion laterally spaced apart from said reentry port; and, an air path extending between said inlet and said outlet and through the exhaust port that develops substantial pressure on said buckets to rotate said rotor.

48. The motor a set forth in claim 47 wherein the exhaust port comprises a major portion with a predetermined width and a neck portion with a reduced width, at least a portion of the length of said neck laterally being spaced apart from said reentry port and separated therefrom by a septum.

49. The motor as set forth in claim 47 wherein, at a given moment in time, at least an initial one of said buckets is positioned in fluid flow communication with the air inlet, half the initial bucket overlies the reentry port, and the other half of the initial bucket overlies a neighboring unmachined portion of the race.

50. The motor as set forth in claim 49 wherein, at a given moment in time, at least one of the succeeding buckets downstream from said initial bucket half overlies the reentry port, and half overlies a portion of the exhaust port, and thus establishes fluid flow communication between said reentry port and said exhaust port.

51. The motor as set forth in claim 50 wherein a plurality of the buckets downstream from said succeeding bucket completely overlie said exhaust port.

52. The motor as set forth in claim 47 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

53. The motor as set forth in claim 52 wherein all of the buckets are sealed when they adjoin unmachined portions of the race.

54. The motor as set forth in claim 52 wherein:

the race establishes 360 degrees of arc;

the reentry port occupies approximately 30 to 40 radial degrees of arc; and, the exhaust port occupies approximately 230 to 260 radial degrees of arc.

55. The motor as set forth in claim 52 wherein each bucket occupies approximately ten degrees of arc.

56. The motor as set forth in claim 55 wherein the reentry port is long enough to border at least four consecutive buckets.

57. The motor as set forth in claim 47 wherein the buckets have a predetermined diameter, and the inlet has an inlet port with a predetermined diameter, and the diameter of the buckets is approximately 3.25 times the diameter of the inlet port.

58. A rotary pneumatic motor comprising:

a rigid casing;

a circular race internally defined in the casing;

a rotor disposed coaxially within said race and comprising a periphery with a plurality of radially spaced apart buckets and a driveshaft projecting from said casing;

an air inlet;

a reentry port laterally offset from said inlet, said reentry port bordering an unmachined surface portion of said race;

an air outlet;

an exhaust port defined in said race providing fluid flow communication to said outlet, the exhaust port comprising a major portion with a predetermined width and a smaller neck portion with a reduced width, at least a portion of the length of said reduced width neck portion laterally spaced apart from said reentry port and separated therefrom by a septum; and, an air path extending between said inlet and said outlet that develops substantial pressure on said buckets to rotate said rotor; and wherein:

incoming air impinging against a first bucket temporarily disposed adjacent said inlet is redirected by said first bucket to said reentry port;

air passing through said reentry port enters a second bucket and pressures said rotor, but cannot reach said exhaust port through said second bucket and instead is returned into said reentry port;

air passing through said reentry port enters third and fourth buckets downstream from said first and second buckets through sides of said third and fourth buckets overlying said reentry port, and is directed from said third and fourth buckets into said exhaust port neck that is bordered by opposite sides of said third and fourth buckets at this time; and, air escaping said reentry port through said third and fourth buckets travels about the periphery of said rotor within said exhaust port and vents through said outlet.

59. The motor as set forth in claim 58 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

60. The motor as set forth in claim 59 wherein:

the race establishes 360 degrees of arc;

the reentry port occupies approximately 30 to 40 radial degrees of arc; and, the exhaust port occupies approximately 230 to 260 radial degrees of arc.

61. The motor as set forth in claim 58 wherein all of the buckets are sealed when they adjoin unmachined portions of the race.

62. A pneumatic motor comprising:

a rigid casing;

a circular race of 360 degrees arc internally defined in the casing;

a rotor disposed within the casing coaxially within said race and comprising a 360 degree periphery with a plurality of radially spaced apart buckets and an inner driveshaft having an end projecting from said casing;

a first bearing press fitted into the casing and engaging one end of said shaft to support the rotor;

a bearing cap adapted to be press fitted to said casing, the cap comprising a hub adapted to be secured by a snap ring for completing the assembly;

a second bearing coaxially engaging an opposite end of said shaft to support the rotor, said second bearing press fitted into said bearing cap;

an air inlet;

a reentry port laterally offset from said inlet;

an air outlet;

an exhaust port defined in said race providing fluid flow communication to said outlet, the exhaust port comprising a portion bordering said reentry port but separated therefrom; and, an air path extending between said inlet and said outlet that develops substantial pressure on said buckets to rotate said rotor.

63. The motor as set forth in claim 62 wherein each bucket is physically defined between disk-like ends of the rotor, and separated from adjoining buckets by a wall having a semicircular top face and bottom face.

64. The motor as set forth in claim 63 wherein said walls separating adjacent buckets are inclined approximately 45 degrees from a hypothetical radius extending outwardly from the rotor center that perpendicularly intersects the rotor periphery adjacent the bucket.

65. The motor as set forth in claim 63 wherein each bucket comprises an innermost curved wall, so air entering one side of the bucket is vigorously redirected out the other side by the curved wall.

66. The motor as set forth in claim 63 wherein the outermost radial surfaces of the disk-like rotor ends are flush with the outermost surfaces of said walls to ensure a substantially airtight seal whenever the moving buckets temporarily face smooth, unmachined portions of the adjoining race.

67. The motor as set forth in claim 63 wherein all of the buckets fall into one of four classes consisting of:

a first class that half overlies the reentry port, and half overlies an unmachined portion of the race;

a second class that half overlies the reentry port, and half overlies a portion of the exhaust port;

a third class that overlies only the exhaust port; and, a fourth class that completely overlies unmachined portions of the race generally between the inlet and the outlet.

68. The motor as set forth in claim 67 wherein:

the reentry port is approximately 30 to 40 radial degrees of arc; and, the exhaust port is approximately 230 to 260 radial degrees of arc.

69. The motor as set forth in claim 68 wherein all of the buckets are sealed when they adjoin unmachined portions of the race.

* * * * *